US010120308B2

(12) United States Patent
Akamatsu et al.

(10) Patent No.: US 10,120,308 B2
(45) Date of Patent: Nov. 6, 2018

(54) IMAGE HEATING DEVICE

(71) Applicant: CANON KABUSHIKI KAISHA, Tokyo (JP)

(72) Inventors: Takaaki Akamatsu, Yokohama (JP); Masashi Tanaka, Kawasaki (JP); Kensuke Umeda, Kawasaki (JP); Shoichiro Ikegami, Yokohama (JP); Sho Taguchi, Fujisawa (JP); Ai Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/647,062

(22) Filed: Jul. 11, 2017

(65) Prior Publication Data

US 2018/0024478 A1 Jan. 25, 2018

(30) Foreign Application Priority Data

Jul. 21, 2016 (JP) ..... 2016-143008

(51) Int. Cl.
*G03G 15/20* (2006.01)
*G03G 15/00* (2006.01)

(52) U.S. Cl.
CPC ..... *G03G 15/2039* (2013.01); *G03G 15/5004* (2013.01)

(58) Field of Classification Search
CPC ..... G03G 15/2039; G03G 15/5004
See application file for complete search history.

(56) References Cited

U.S. PATENT DOCUMENTS 9,229,388 B2 * 1/2016 Imaizumi ..... G03G 15/2017
9,513,586 B2 * 12/2016 Narahara ..... G03G 15/55
9,523,951 B2 * 12/2016 Suzuki ..... G03G 15/2064

FOREIGN PATENT DOCUMENTS

JP H06318002 A 11/1994
JP 2002267543 A 9/2002
JP 2009122237 A 6/2009
JP 2011118246 A 6/2011

* cited by examiner

*Primary Examiner* — Gregory H Curran
(74) *Attorney, Agent, or Firm* — Canon U.S.A., Inc. IP Division

(57) ABSTRACT

An image heating device includes a rotator, a heater including a heat generating resistor, a connector electrically connected to the heater, and a power interrupting unit that detects an abnormal temperature rise of the heater and interrupt supply of the power to the heater. The power interrupting unit includes a first terminal and a second terminal, a first conductive sheet metal that electrically connects the connector to the first terminal, a second conductive sheet metal that to electrically connects the connector to the second terminal via the heat generating resistor, a length of the second conductive sheet metal being different from a length of the first conductive sheet metal in the longitudinal direction of the heater, and a supporting member supporting the heater and including a regulation portion that regulates rotation of the power interrupting unit.

19 Claims, 7 Drawing Sheets

IMAGE HEATING DEVICE

BACKGROUND OF THE INVENTION

Field of the Invention

The disclosure relates to an image heating device that can be used as a fixing device installed in an image forming apparatus, such as an electrophotographic copier and an electrophotographic printer.

Description of the Related Art

A fixing device with a cylindrical film is known as a fixing device installed in an electrophotographic copier or printer. Such a fixing device includes the cylindrical film, a holder inserted into the film, and a heater. The heater contacts an inner surface of the film supported by the holder to heat the film. An unfixed toner image on a recording medium is fixed on the recording medium with heat of the film.

This fixing device has advantages in shortening warm-up time and lowering power consumption during standby.

The heater supported by the holder contacts a thermistor through a hole portion arranged in the holder. The thermistor detects temperature of the heater to maintain the temperature (control target temperature) of the heater in a suitable range. Further, the heater contacts a temperature fuse through a hole portion arranged in the holder. The temperature fuse interrupts power application to the heater if temperature of the heater exceeds the suitable temperature range, to prevent temperature from excessive rising.

Japanese Patent Application Laid-Open No. 2011-118246 discusses an electric wire that is used as a conductive member (a power supplying wire) connected to a terminal of a temperature fuse.

In many cases, the electric wire connected to the terminal of the temperature fuse is formed of, for example, a metal stranded wire. Such an electric wire has good flexibility but has poor shape-stability. Consequently, when the electric wire is used, a position of the temperature fuse does not tend to be stable with respect to the heater. Thus, the electric wire needs to have a non-conductive cover as a surface layer to maintain an insulation property with respect to a metal stay arranged on a side opposite the holder of the heater. In general, an electric cable including a cover with a good insulation property is costly. Moreover, an electric cable with a sufficient heat resistance can have a thicker cover layer. In such a case, the electric cable occupies a larger space, causing a difficulty in reducing size of the fixing device.

SUMMARY OF THE INVENTION

According to an aspect of the disclosure, an image heating device that heats an image on a recoding medium includes a rotator, a heater having an elongated shape, configured to heat the rotator, the heater including a heat generating resistor that generates heat by receiving power, a connector electrically connected to a longitudinal end portion of the heater to supply the power to the heater, a power interrupting unit configured to detect an abnormal temperature rise of the heater and interrupt supply of the power to the heater, the power interrupting unit including a first terminal and a second terminal, a first conductive sheet metal configured to electrically connect the connector to the first terminal, the first conductive sheet metal extending in a longitudinal direction of the heater, a second conductive sheet metal configured to electrically connect the connector to the second terminal via the heat generating resistor, the second conductive sheet metal extending in the longitudinal direction of the heater, a length the second conductive sheet metal in the longitudinal direction of the heater being different from a length of the first conductive sheet metal in the longitudinal direction of the heater, and a supporting member configured to support the heater, the supporting member including a regulation portion configured to regulate rotation of the power interrupting unit, wherein the image formed on the recording medium is heated with heat from the heater via the rotator.

Further features and aspects of the disclosure will become apparent from the following description of various example embodiments with reference to the attached drawings.

DESCRIPTION OF THE EMBODIMENTS

Hereinafter, example embodiments of the disclosure are described with reference to the drawings. However, the disclosure is not limited to the example embodiments described below, and various modifications are possible within a concept of the disclosure.

(1) Example Image Forming Apparatus

Figure 7:
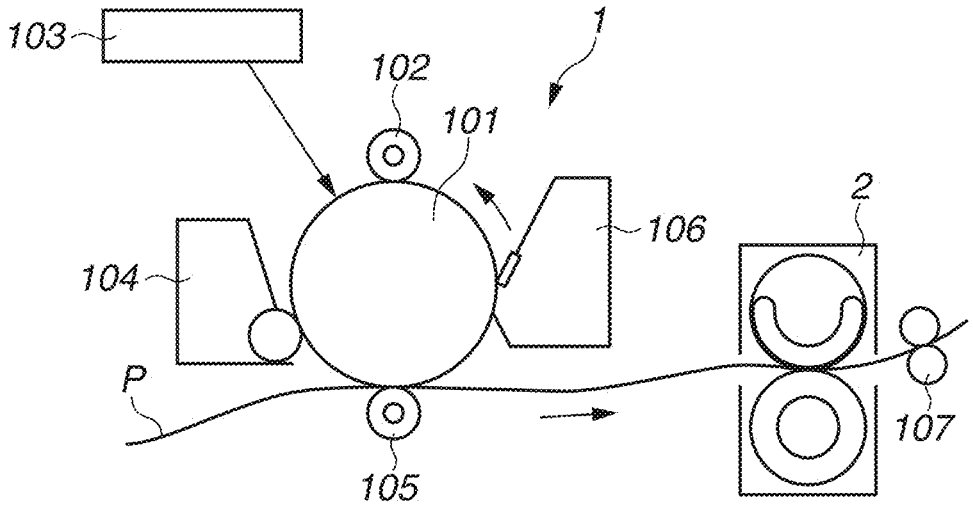
FIG. 7 is a sectional view illustrating a schematic configuration of an image forming apparatus.

An example image forming apparatus including an image heating device serving as a fixing device according to an example embodiment is described with reference to FIG. 7. FIG. 7 is a sectional view illustrating a schematic configuration of an example of the image forming apparatus (a monochrome printer in the present example embodiment) employing an electrophotographic recording technique.

The image forming apparatus includes an image forming unit 1 that forms a toner image on a recording medium P. The image forming unit 1 includes a photoconductor drum 101 as an image bearing member, a charging member 102, and a laser scanner 103. Further, the image forming unit 1 includes a developing unit 104, a cleaner 106 that cleans an outer peripheral surface (a surface) of the photoconductor drum 101, and a transfer member 105. Since an operation of the image forming unit 1 is known, a detailed description thereof is omitted.

A recording medium P stored in a cassette (not illustrated) is conveyed by rotation of a roller (not illustrated) to transfer portion formed by the photoconductor drum 101 and the transfer member 105. A toner image is transferred to the recording medium P in the transfer portion, and then the recording medium P with the transferred toner image is conveyed to a fixing device (a fixing unit) 2. In the fixing device 2, the toner image is fixed on the recording medium P with heat. Subsequently, the recording medium P is discharged by rotation of a roller 107 to a tray (not illustrated).

(2) Example Fixing Device 2

(2-1) Overall Example Configuration

Figure 1:
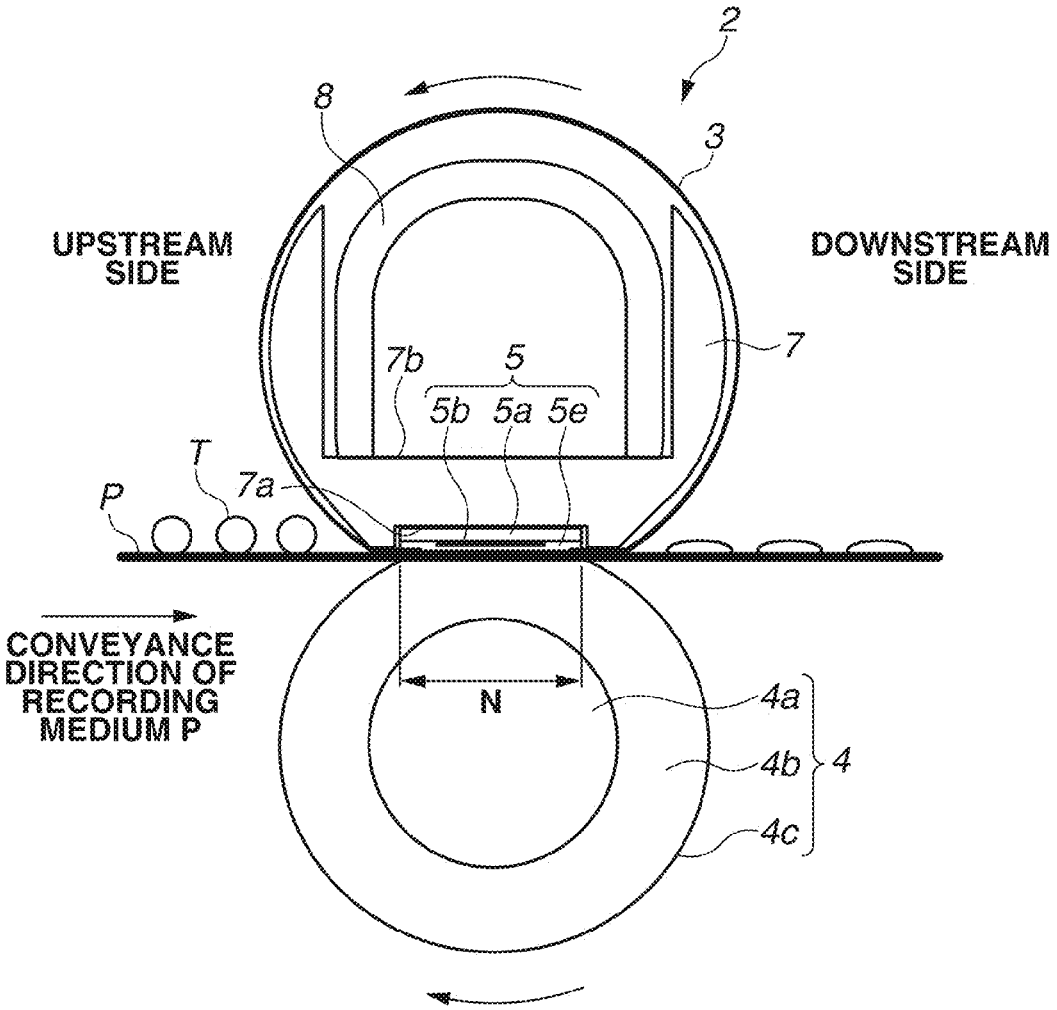
FIG. 1 is a sectional view illustrating a schematic configuration of an example fixing device.
Figure 2A:
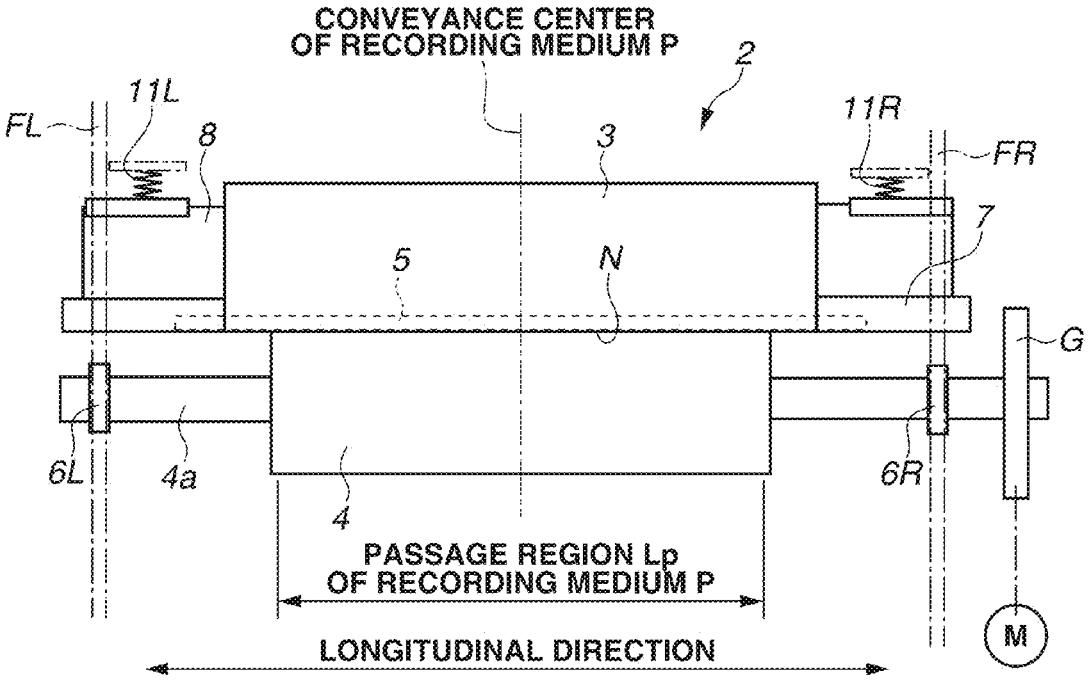
FIG. 2A is a diagram illustrating the fixing device as seen from an upstream side in a recording medium conveyance direction.
Figure 2B:
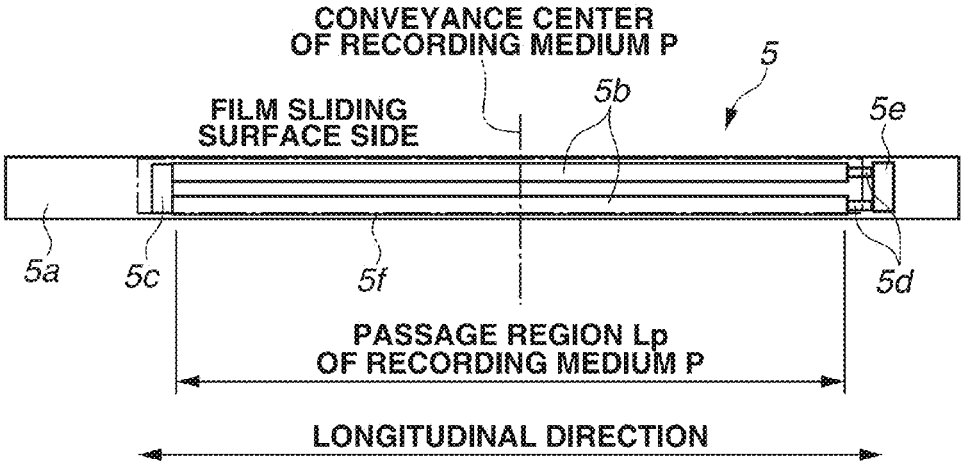
FIG. 2B is a diagram illustrating a configuration of a film sliding surface side of a heater.

The fixing device 2 described in the present example embodiment employs a film heating method. FIG. 1 is a sectional view illustrating a schematic configuration of the fixing device 2 according to the present example embodiment. FIG. 2A is a diagram illustrating the fixing device 2 as seen from an upstream side in a conveyance direction of a recording medium P, and FIG. 2B is a diagram illustrating a configuration of a film sliding surface side of a heater 5.

The fixing device 2 includes a cylindrical film. (a rotation member) 3, a heater (a heat generating member) 5 having a plate shape, a holder (a supporting member) 7, a stay (a pressure member) 8, and a pressure roller (a pressure rotation member) 4.

The holder 7 made of heat-resistance resin includes a groove 7*a* arranged on a flat surface thereof. With the groove 7*a*, the holder 7 supports the heater 5 in a longitudinal direction perpendicular to the conveyance direction of the recording medium P. The stay 8 made of metal is mounted on a flat surface 7*b* opposite a side of the groove 7*a* of the holder 7. The holder 7 which supports the heater 5 and on which the stay 8 is mounted is arranged inside the film 3 having flexibility and heat resistance property. In the longitudinal direction perpendicular to the conveyance direction of the recording medium P, both ends of the holder 7 are respectively supported by left and right frames FL and FR of the fixing device 2.

The heater 5 includes a substrate 5*a* having an elongated-shape made of ceramics having an insulation property. The substrate 5*a* has a surface (a film sliding surface) at a side opposite the holder 7, and a pair of heat generating resistors 5*b* and a conductive pattern 5*c* are arranged the film sliding surface. The heat generating resistors 5*b* generate heat along a longitudinal direction of the substrate 5*a* by power application. The conductive pattern 5*c* is electrically connected to an end in a longitudinal direction of each of the heat generating resistors 5*b*. Further, a pair of conductive patterns 5*d* and an electrode 5*e* are arranged on the film sliding surface of the substrate 5*a*. Each of the conductive patterns 5*d* is electrically connected to the other end in the longitudinal direction of a different one of the heat generating resistors 5*b*. The electrode 5*e* is used to supply power to the conductive patterns 5*d*.

Moreover, an over-coat layer 5*f* having an insulation property is arranged on the film sliding surface of the substrate 5*a*. The over-coat layer 5*f* protects each of the heat generating resistors 5*b*, the conductive pattern 5*c*, and each of the conductive patterns 5*d*.

A power supply (not illustrated) supplies power to the electrode 5*e* of the heater 5 via a connector (a power feeding member) 17 (see FIG. 4) attached to the holder 7. The power is then applied from the electrode 5*e* to the heat generating resistors 5*b* via the conductive patterns 5*d*.

The pressure roller 4 includes a core metal 4*a*, an elastic layer 4*b* arranged on an outer peripheral surface of the core metal 4*a*, and a release layer 4*c* arranged to cover an outer peripheral surface of the elastic layer 4*b*. The pressure roller 4 is arranged in a position opposite the heater 5 via the film 3. In the longitudinal direction perpendicular to the conveyance direction of the recording medium P, both ends of the core metal 4*a* of the pressure roller 4 are rotatably supported by the frames FL and FR via bearings 6L and 6R, respectively.

In the longitudinal direction perpendicular to the conveyance direction of the recording medium P, both end portions of the stay 8 are pressed toward a vertical direction perpendicular to a generatrix direction of the film 3 by pressurizing springs 11L and 11R. With the pressure of the pressurizing springs 11L and 11R, the stay 8 evenly presses the holder 7 in the longitudinal direction perpendicular to the conveyance direction of the recording medium P. Accordingly, the holder 7 presses the heater 5 to an inner peripheral surface (an inner surface) of the film 3, so that an outer peripheral surface (a surface) of the film 3 is pressed against an outer peripheral surface (a surface) of the pressure roller 4. Thus, the elastic layer 4*b* of the pressure roller 4 is elastically deformed, and a surface of the pressure roller 4 and a surface of the film 3 forms a nip portion N having a predetermined width.

Figure 3:
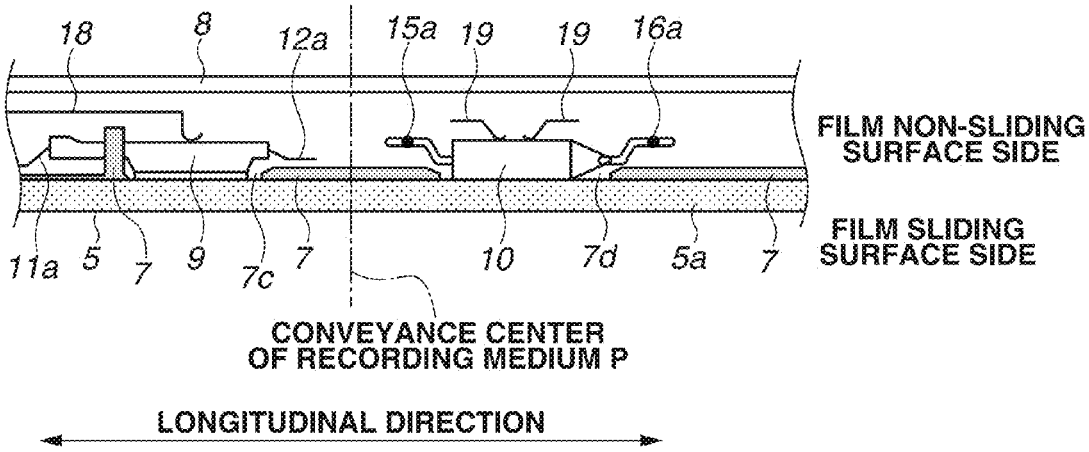
FIG. 3 is a diagram illustrating arrangement of a thermistor and a temperature fuse with respect to the heater.
Figure 4:
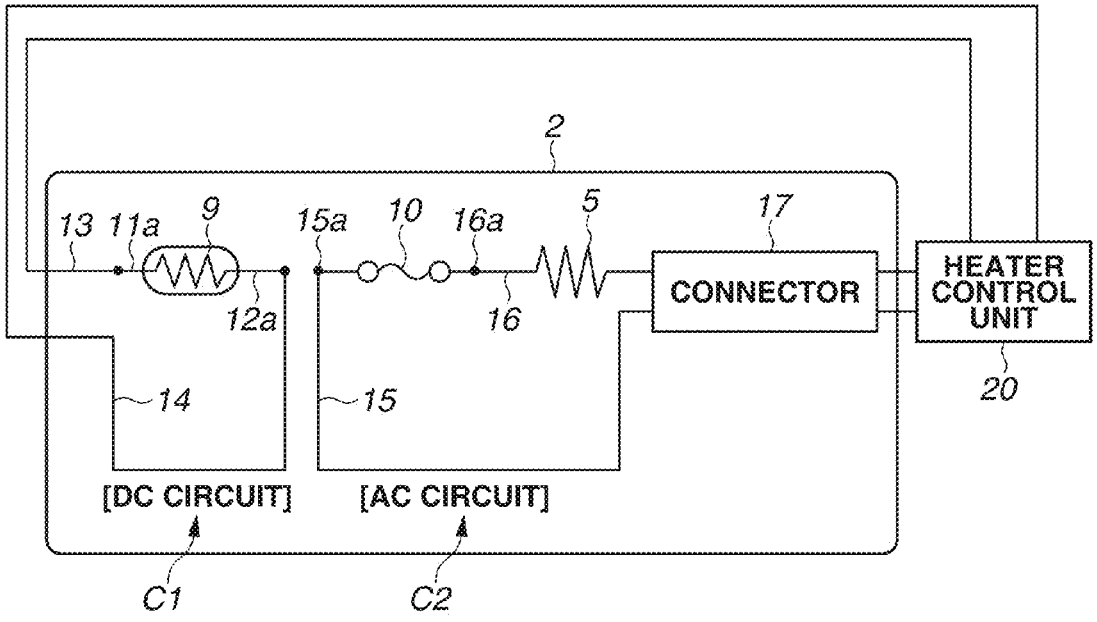
FIG. 4 is a diagram illustrating a direct current (DC) circuit including the thermistor and an alternating current (AC) circuit including the temperature fuse.

FIG. 3 is a diagram illustrating an example arrangement of a thermistor 9 and a temperature fuse 10 with respect to the heater 5. FIG. 4 is a diagram illustrating a direct current (DC) circuit C1 including the thermistor 9, and an alternating current (AC) circuit C2 including the temperature fuse 10.

The DC circuit (a temperature detecting circuit) C1 and the AC circuit (a heat generating circuit) C2 as illustrated in FIG. 4 are arranged on the flat surface 7*b* (see FIG. 1) of the holder 7.

In the DC circuit C1, the thermistor (a temperature detecting member) 9 is electrically connected by wires 13 and 14, to a heater control unit 20 arranged outside the fixing device 2.

In the AC circuit C2 the electrical connection is made in the following order: a connector 17, a first rigid sheet metal 15 having conductivity, a terminal 15*a* of the temperature fuse (a power application interrupting member) 10, the temperature fuse 10, a terminal 16*a* of the temperature fuse 10, a second rigid sheet metal 16 having conductivity, and the heater (the heat generating resistors 5*b*) 5, and the connector 17. That is, the first rigid sheet metal 15 is configured such that the connector 17 and the terminal 15*a* are electrically connected. Further, the second rigid sheet metal 16 is configured such that the connector 17 and the terminal 16*a* are electrically connected via the heat generating resistors 5*b*. The connector 17 is electrically connected to the heater control unit 20. The first rigid sheet metal (a first rigid member) 15 and the second rigid sheet metal (a second rigid member) 16 will be described in detail below.

The thermistor 9 and the temperature fuse 10 are arranged in the longitudinal direction perpendicular to the conveyance direction of the recording medium P and disposed in a passage region Lp. The passage region Lp is a region where a recording medium P passes the nip portion N of the fixing device 2 as illustrated in FIG. 2A. As illustrated in FIG. 3, the thermistor 9 and the temperature fuse 10 are arranged in predetermined positions that are symmetric about a conveyance center of the recording medium P, on a surface (a film non-sliding surface) of the holder 7 side of the substrate 5*a* of the heater 5.

The thermistor 9 includes thermistor wires 11*a* and 12*a* that are electrically connected in series to the first and second wires 13 and 14, respectively (see FIG. 4). The thermistor 9 detects temperature of the heater 5, and outputs a detection signal of the detected temperature to the heater control unit 20 via the first and second wires 13 and 14.

Figure 5:
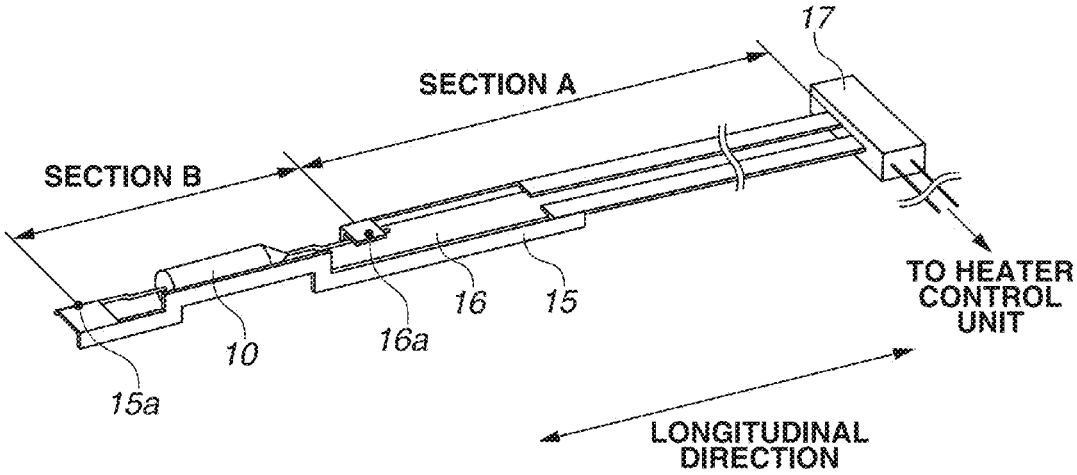
FIG. 5 is a perspective view illustrating the AC circuit.

The temperature fuse 10 includes the terminals 15*a* and 16*a* which are electrically connected in series to the first and second rigid sheet metals 15 and 16, respectively (see FIGS. 4 and 5). If temperature of the heater 5 excessively rises, the temperature fuse 10 does not allow conduction between the terminal 15*a* and the terminal 16*a* to interrupt the power application (the supply of power) to the heater 5.

Such arrangement of the thermistor 9 and the temperature fuse 10 enables temperature of the heater 5 to be maintained in an appropriate range, and also enables a toner image T to be prevented from being fixed when the temperature of the heater 5 excessively rises. In addition, since the thermistor 9 and the temperature fuse 10 are disposed in the passage region Lp of the recording medium P, temperature of the heater 5 can be detected for almost every size of a recording medium out of recording media that can pass the nip portion N. However, the disposition locations of the thermistor 9 and the temperature fuse 10 are not limited to those described in the present example embodiment.

Further, the thermistor 9 and the temperature fuse 10 are arranged so as to be exposed to the heater 5 side from respective hole portions 7*c* and 7*d* formed on the holder 7. The thermistor 9 is urged toward the heater 5 by a pressurizing spring 18 and pressed against the substrate 5*a*. The temperature fuse 10 is urged toward the heater 5 by a pressurizing spring 19 and pressed against the substrate 5*a*. Accordingly, the thermistor 9 and the temperature fuse 10 can be attached to the holder 7 in a state in which the thermistor 9 and the temperature fuse 10 are in contact with the heater 5.

In the present example embodiment, the pressurizing springs 18 and 19 urge the thermistor 9 and the temperature fuse 10, respectively, so that the thermistor 9 and the temperature fuse 10 contact the substrate 5*a* of the heater 5. However, the temperature fuse 10 and the heater 5 may not necessarily contact each other. For example, a thermal conductive spacer or the like may be interposed between the temperature fuse 10 and the heater 5. Alternatively, a certain distance (space) may be provided between the temperature fuse 10 and the heater 5 such that the temperature fuse 10 can detect heat of the heater 5.

(2-2) Example Heat Fixing Process Operation

The core metal 4*a* of the pressure roller 4 receives a driving force of a motor M transmitted via a gear G, and the pressure roller 4 is rotated in a direction indicated by an arrow illustrated in FIG. 1 by the driving force. The film 3 follows the rotation of the pressure roller 4 and rotates in a direction indicated by another arrow illustrated in FIG. 1 while an inner peripheral surface (an inner surface) of the film 3 is sliding across the over-coat layer 5*f* of the heater 5. Grease may be applied between the over-coat layer 5*f* of the heater 5 and the inner surface of the film 3 to enhance the easiness of sliding.

When the power is supplied from the power supply to the electrode 5*e* of the heater 5 via the connector 17, the heat generating resistors 5*b* generates heat. Thus, temperature of the heater 5 rapidly rises. The heater control unit 20 controls an amount of the power supplied to the heater 5 such that a temperature of the heater 5 to be detected by the thermistor 9 is maintained in a predetermined fixing temperature (a target temperature).

The recording medium P bearing an unfixed toner image T is fed to the nip portion N. In the nip portion N, the recording medium P is heated with heat of the heater 5 while being conveyed. The toner image T on the recording medium P is thus fixed on t e recording medium P.

(2-3) Insulation of DC Circuit C1 and AC Circuit C2

The first and second rigid sheet metals 15 and 16 of the AC circuit C2 extend along the heater 5 in the longitudinal direction perpendicular to the conveyance direction of the recording medium P. Since the holder 7 supporting the heater 5 is in a high temperature state by the heat transferred from the heater 5, a large quantity of the heat is also transferred to the first and second rigid sheet metals 15 and 16.

Meanwhile, the AC circuit C2, which includes the temperature fuse 10 and causes the heater 5 to generate heat, and the DC circuit C1, which includes the thermistor 9, need to be insulated for operation of the DC circuit C1 and the AC circuit C2. Since the thermistor 9 and the temperature fuse 10 can be arranged substantially symmetric about the conveyance center of the recording medium P, a distance that is necessary for the AC circuit C2 and the DC circuit C1 to be insulated can be readily maintained.

However, since the stay 8 is also mounted on the flat surface 7*b* of the holder 7 (see FIG. 1), a distance that is necessary for the AC circuit C2 and the DC circuit C1 to be insulated via the stay 8 is needed. Accordingly, the AC circuit C2 needs to be accurately arranged on the flat surface 7*b* of the holder 7 to ensure an insulation distance. Alternatively, the AC circuit C2 needs to be covered with an insulation cover having a good heat resistance.

In the present example embodiment, the first rigid sheet metal (first conductive sheet metal) 15 and the second rigid sheet metal (second conductive sheet metal) 16 having conductivity are used for the AC circuit C2 as conductive members having good shape-stability, instead of using a metal stranded wire (an electric cable) covered with a cover layer having an insulation property. Hereinafter, a configuration of the AC circuit C2 is described in detail.

(2-4) Example Configuration of AC Circuit C2

FIG. 5 is a perspective view illustrating a configuration of the AC circuit C2.

The temperature fuse 10 includes the terminal (first terminal) 15*a* and the terminal (second terminal) 16*a* which are arranged along a longitudinal direction of the heater 5 in the longitudinal direction perpendicular to the conveyance direction of the recording medium P. The terminal 15*a* and the terminal 16*a* extend in opposite directions in the longitudinal direction of the heater 5. The first rigid sheet metal 15 electrically connected to the terminal 15*a* can be simply extended to outside the holder 7 from the terminal 15*a* side, to connect the first rigid sheet metal 15 to the heater control unit 20. Alternatively, the first rigid sheet metal 15 electrically connected to the terminal 15*a* can be folded toward the terminal 16*a* side to extend to outside the holder 7.

In the former configuration, since the AC circuit C2 is disposed near the DC circuit C1 of the thermistor 9, an insulation cover may be necessary due to an inappropriate insulation distance. The present example embodiment therefore has the latter configuration, i.e., the configuration in which the first rigid sheet metal 15 electrically connected to the terminal 15*a* is folded toward the terminal 16*a* side to extend to outside the holder 7.

(2-5) Example Positioning (Rotation Regulation) Configuration of Temperature Fuse 10

Figure 6A:
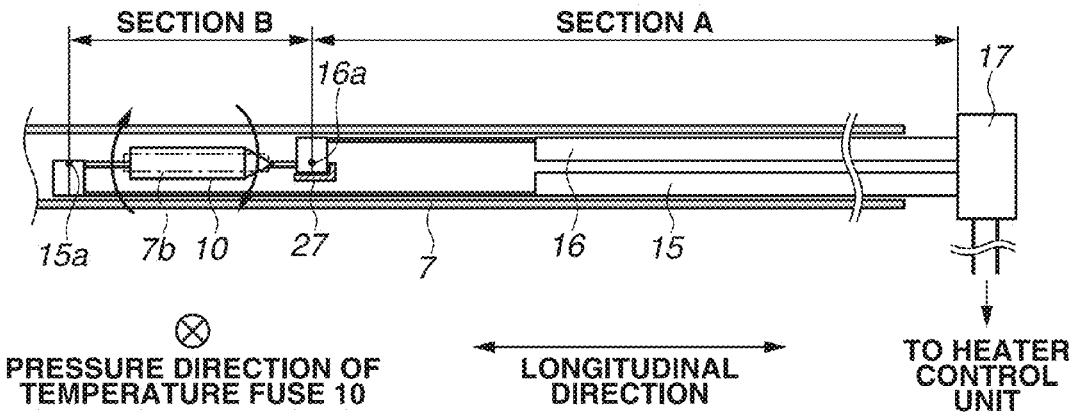
FIGS. 6A and 6B are diagrams illustrating a positioning configuration of the temperature fuse.
Figure 6B:
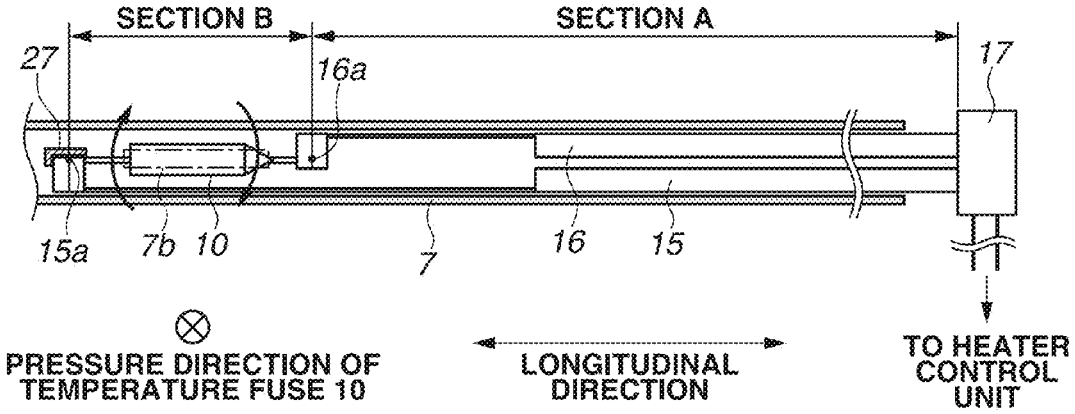

FIGS. 6A and 6B are diagrams illustrating a positioning configuration of the temperature fuse 10. FIG. 6A illustrates a state in which the terminal 16*a* of the temperature fuse 10 is in contact with a positioning unit (a rotation regulation portion) 27. FIG. 6B illustrates a state in which the terminal 15*a* of the temperature fuse 10 is in contact with the positioning unit 27.

The first rigid sheet metal 15 and the second rigid sheet metal 16 are electrically connected to the connector 17 positioned with respect to the holder 7. A position of the connector 17 is determined with respect to the holder 7. The holder 7 is provided with the positioning unit 27 arranged between the first rigid sheet metal 15 and the second rigid sheet metal 16. The positioning unit 27 regulates a position of the temperature fuse 10 to an operable position.

Temperature of each of the first and second rigid sheet metals 15 and 16 rises by the heat transferred from the heater 5 as mentioned above, and thus the first and second rigid sheet metals 15 and 16 are thermally expanded. Since the first rigid sheet metal 15 is longer than the second rigid sheet metal 16 by a section B in the longitudinal direction, the first rigid sheet metal 15 has a larger expansion amount (a thermal expansion amount) by the thermal expansion than the second rigid sheet metal 16. Accordingly, a rotary force is added to the temperature fuse 10. In particular, a rotary force is added to the temperature fuse 10 in a clockwise direction indicated by arrows with respect to a pressure direction (a vertical direction with respect to a paper surface). As a result, a contact state between the temperature fuse 10 and the heater 5 can be changed (misregistration), and an operation of the temperature fuse 10 (a power application interrupting operation) may become unstable.

However, as illustrated in FIG. 6A, the temperature fuse 10 is retained by the positioning unit 27. Such retention can prevent (regulate) misregistration (rotation) of the temperature fuse 10 with respect to the heater 5. That is, when the first rigid sheet metal 15 is thermally expanded by a rise in temperature and a rotary force is applied to the temperature fuse 10, the positioning unit 27 contacting the temperature fuse 10 (the terminal 16*a* in the present example embodiment) maintains the temperature fuse 10 in an operable position. That is, the positioning unit 27 serves as an insulation wall arranged between the first rigid sheet metal 15 and the second rigid sheet metal 16.

The use of the positioning unit 27 can prevent misregistration of the temperature fuse 10. Consequently, an operation of the temperature fuse 10 can be stabilized.

The example illustrated in FIG. 6A has been described using a configuration in which a position of the temperature fuse 10 is regulated to an operable position by the positioning unit 27 arranged near the first rigid sheet metal 15. However, the positioning unit 27 may be arranged near the second rigid sheet metal 16 as illustrated in FIG. 6B, instead of the vicinity of the first rigid sheet metal 15. The example in FIG. 6B describes a configuration in which a position of the temperature fuse 10 is regulated by the positioning unit 27 arranged near the second rigid sheet metal 16. As long as a position of the temperature fuse 10 can be stable, either configuration can be employed.

Alternatively, two positioning units 27 for the temperature fuse 10 may be arranged in the longitudinal direction perpendicular to the conveyance direction of the recording medium P and disposed in a position in which a distance between the first and second rigid sheet metals 15 and 16 is the shortest. Such arrangement can enhance insulation property between the first rigid sheet metal 15 and the second rigid sheet metal 16.

In the present example embodiment, the positioning unit 27 for the temperature fuse 10 is arranged as a portion of the holder 7. Alternatively, for example, another positioning member secured to the holder 7 can be provided to any position where an operation of the temperature fuse 10 can be stabilized. Further, shape of the positioning unit 27 and the number of positioning units 27 for the temperature fuse 10 are not limited to those described in the present example embodiment, and any shape and any number which can prevent misregistration of the temperature fuse 10 and can stabilize an operation of the temperature fuse 10 may be adopted.

Further, in the present example embodiment, the regulation target is the rotation of the temperature fuse 10. In that sense, the terminal 16*a* of the temperature fuse 10 does not necessarily contact the positioning unit 27. Similarly, the same can be said about the terminal 15*a*.

Further, a portion for regulating the rotation of the temperature fuse 10 by the positioning unit 27 does not need to be the terminal 16*a*. A portion of the second rigid sheet metal 16 connected to the terminal 16*a* may be used. Alternatively, a portion of the first rigid sheet metal 15 connected to the terminal 15*a* may be used.

In the fixing device 2 according to the present example embodiment, a power interrupting unit is not limited to the temperature fuse. A thermo switch may be used as a power interrupting unit.

The rigid member is not limited to the plate-shaped rigid sheet metal. A linear shaped rigid member may be used. Alternatively, a rigid member may be a plurality of plate-shaped or linear shaped rigid members bonded or integrated with each other.

The first rigid sheet metal 15 is folded toward the terminal 16*a* side of the temperature fuse 10 and connected to the connector 17 so that misregistration of the temperature fuse 10 is prevented and an operation of the temperature fuse 10 is stabilized. That is, the first rigid sheet metal 15 and the second rigid sheet metal 16 connected to the temperature fuse 10 are connected to the connector 17 on the same side as the heater 5 in the longitudinal direction perpendicular to the conveyance direction of the recording medium P.

However, the present example embodiment is not limited to such a configuration if there is a possibility that a position of the temperature fuse 10 may become unstable at an excessive temperature rise of the heater 5. For example, the first rigid sheet metal 15 can be simply extended toward the terminal 15*a* of the temperature fuse 10 and extended to outside the holder 7. That is, the first rigid sheet metal 15 connected to the temperature fuse 10 can be connected to the connector 17 at a side different from the side of the heater 5 in the longitudinal direction perpendicular to the conveyance direction of the recording medium P. Such a configuration can also prevent misregistration of the temperature fuse 10 and stabilize an operation of the temperature fuse 10.

Another Example Embodiment

The image heating device according to the present disclosure is not limited to the use of the image heating device as the fixing device according to the above-described example embodiment. The image heating device can also be effectively used as a device that modifies gloss of an image once fixed or temporarily fixed on a recording medium.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-143008, filed Jul. 21, 2016, which is hereby incorporated by reference herein in its entirety.

What is claimed is:

1. An image heating device heating an image on a recoding medium, the image heating device comprising:

a rotator;

a heater having an elongated and plate-like shape, configured to heat the rotator, the heater including a heat generating resistor that generates heat by receiving power, wherein the image formed on the recording medium is heated with heat from the heater via the rotator;

a connector electrically connected to one of longitudinal end portions of the heater to supply the power to the heater;

a power interrupting unit configured to interrupt supply of the power to the heater in response to an abnormal temperature rise of the heater, the power interrupting unit including a first electrical terminal which extends in a direction away from the connector in a longitudinal direction of the heater and a second electrical terminal which extends in a direction approaching the connector in the longitudinal direction of the heater;

a first conductive sheet metal that electrically connects the connector to the first electrical terminal, the first conductive sheet metal extending in the longitudinal direction of the heater;

a second conductive sheet metal that electrically connects the connector to the second electrical terminal, the second conductive sheet metal extending in the longitudinal direction of the heater, a length of the second conductive sheet metal in the longitudinal direction of the heater being shorter than a length of the first conductive sheet metal in the longitudinal direction of the heater; and a regulation portion configured to regulate rotation of the power interrupting unit about a rotational axis crossing a surface of the heater.

2. The image heating device according to claim 1, wherein the regulation portion is arranged so as to face a first connecting portion of the first conductive sheet metal to which the first electrical terminal is connected, the regulation portion being arranged between the first connecting portion of the first conductive sheet metal and one end of the heater closer to the second conductive metal sheet than the other end of the heater in a width direction of the heater perpendicular to the longitudinal direction of the heater.

3. The image heating device according to claim 1, wherein the regulation portion is arranged so as to face a second connecting portion of the second conductive sheet metal to which the second electrical terminal is connected, the regulation portion being arranged between the second connecting portion of the second conductive sheet metal and the first conductive sheet metal.

4. The image heating device according to claim 1, wherein, in the longitudinal direction of the heater, the first conductive sheet metal and the power interrupting unit overlap with each other in a region which is further from the connecter than the longitudinal end portion of the second conductive sheet metal.

5. The image heating device according to claim 4, wherein a portion of the first conductive sheet metal overlapping with the power interrupting unit is configured such that a thickness direction of the first conductive sheet metal is parallel to a width direction of the heater perpendicular to both a longitudinal direction of the heater and a thickness direction of the heater.

6. The image heating device according to claim 1, wherein the second conductive metal sheet is electrically connected to the connector via the heat generating resistor.

7. The image heating device according to claim 1, wherein the power interrupting unit is provided on the heater.

8. The image heating device according to claim 1, wherein the power interrupting unit is provided on a heat conductive member contacting the heater.

9. The image heating device according to claim 1, wherein the power interrupting unit is a temperature fuse.

10. An image heating device heating an image on a recoding medium, the image heating device comprising:

a rotator;

a heater having an elongated and plate-like shape, configured to heat the rotator, the heater including a heat generating resistor that generates heat by receiving power, wherein the image formed on the recording medium is heated with heat from the heater via the rotator;

a connector electrically connected to one of longitudinal end portions of the heater to supply the power to the heater;

a power interrupting unit configured to interrupt supply of the power to the heater in response to an abnormal temperature rise of the heater, the power interrupting unit including a first electrical terminal which extends in a direction away from the connector in a longitudinal direction of the heater and a second electrical terminal which extends in a direction approaching the connector in the longitudinal direction of the heater;

a first conductive sheet metal that electrically connects the connector to the first electrical terminal, the first conductive sheet metal extending in the longitudinal direction of the heater;

a second conductive sheet metal that electrically connects the connector to the second electrical terminal, the second conductive sheet metal extending in the longitudinal direction of the heater, a length of the second conductive sheet metal in the longitudinal direction of the heater being shorter than a length of the first conductive sheet metal in the longitudinal direction of the heater; and a regulation portion configured to regulate a movement of the power interrupting unit, the regulation portion facing a second connecting portion of the second conductive sheet metal to which the second electrical terminal is connected, the regulation portion being arranged between the second connecting portion of the second conductive sheet metal and the first conductive sheet metal.

11. The image heating device according to claim 10, wherein the second conductive metal sheet is electrically connected to the connector via the heat generating resistor.

12. The image heating device according to claim 10, wherein the power interrupting unit is provided on the heater.

13. The image heating device according to claim 10, wherein the power interrupting unit is provided on a heat conductive member contacting the heater.

14. The image heating device according to claim 10, wherein the power interrupting unit is a temperature fuse.

15. An image heating device heating an image on a recoding medium, the image heating device comprising:

a rotator;

a heater having an elongated and plate-like shape, configured to heat the rotator, the heater including a heat generating resistor that generates heat by receiving power, wherein the image formed on the recording medium is heated with heat from the heater via the rotator;

a connector electrically connected to one of longitudinal end portions of the heater to supply the power to the heater;

a power interrupting unit configured to interrupt supply of the power to the heater in response to an abnormal temperature rise of the heater, the power interrupting unit including a first electrical terminal which extends in a direction away from the connector in a longitudinal direction of the heater and a second electrical terminal which extends in a direction approaching the connector in the longitudinal direction of the heater;

a first conductive sheet metal that electrically connects the connector to the first electrical terminal, the first conductive sheet metal extending in the longitudinal direction of the heater;

a second conductive sheet metal that electrically connects the connector to the second electrical terminal, the second conductive sheet metal extending in the longitudinal direction of the heater, a length of the second conductive sheet metal in the longitudinal direction of the heater being shorter than a length of the first conductive sheet metal in the longitudinal direction of the heater; and a regulation portion configured to regulate a movement of the power interrupting unit, the regulation portion facing a first connecting portion of the first conductive sheet metal to which the first electrical terminal is connected, the regulation portion being arranged between the first connecting portion of the first conductive sheet metal and one end of the heater closer to the second conductive metal sheet than the other end of the heater in a width direction of the heater perpendicular to both the longitudinal direction of the heater and a thickness direction of the heater.

16. The image heating device according to claim 15, wherein the second conductive metal sheet is electrically connected to the connector via the heat generating resistor.

17. The image heating device according to claim 15, wherein the power interrupting unit is provided on the heater.

18. The image heating device according to claim 15, wherein the power interrupting unit is provided on a heat conductive member contacting the heater.

19. The image heating device according to claim 15, wherein the power interrupting unit is a temperature fuse.

* * * * *